United States Patent [19]

Goddard

[11] 4,172,743

[45] * Oct. 30, 1979

[54] COMPOSITIONS OF BIS-TRIAMINOGUANIDINE DECAHYDRODECABORATE AND TAGN

[75] Inventor: Terrence P. Goddard, Aptos, Calif.

[73] Assignee: Teledyne McCormick Selph, an operating Division of Teledyne Industries, Inc., Hollister, Calif.

[ * ] Notice: The portion of the term of this patent subsequent to Dec. 19, 1995, has been disclaimed.

[21] Appl. No.: 882,829

[22] Filed: Mar. 2, 1978

Related U.S. Application Data

[60] Division of Ser. No. 853,917, Nov. 22, 1977, Pat. No. 4,108,697, which is a continuation-in-part of Ser. No. 762,229, Jan. 24, 1977, Pat. No. 4,130,585.

[51] Int. Cl.[2] ..... C06B 43/00

[52] U.S. Cl. ..... 149/22; 149/92

[58] Field of Search ..... 149/22, 36, 92

[56] References Cited

U.S. PATENT DOCUMENTS

| | | | |
|---|---|---|---|
| 3,126,305 | 3/1964 | Armstrong | 149/22 |
| 3,668,873 | 6/1972 | Bauman | 149/22 |
| 4,002,681 | 1/1977 | Goddard | 149/18 |
| 4,080,902 | 3/1978 | Goddard et al. | 149/22 |
| 4,108,697 | 8/1978 | Goddard | 149/22 |
| 4,130,585 | 12/1978 | Goddard | 149/22 |

*Primary Examiner*—Edward A. Miller

*Attorney, Agent, or Firm*—David H. Semmes; Warren E. Olsen

[57] ABSTRACT

This invention describes pyrotechnic compositions made by suitably combining, preferably by coprecipitation, triaminoguanidine nitrate with bis-triaminoguanidinium decahydrodecaborate. Propellants comprising these compounds are also included.

8 Claims, 2 Drawing Figures

COMPOSITIONS OF BIS-TRIAMINOGUANIDINE DECAHYDRODECABORATE AND TAGN

CROSS-REFERENCE TO RELATED APPLICATIONS:

This application is a division of my application entitled NOVEL TRIAMINOGUANIDINE NITRATE PROPELLANTS AND IGNITION COMPOUNDS, Ser. No. 853,917, filed Nov. 22, 1977, now U.S. Pat. No. 4,108,697, which in turn is a continuation-in-part of my earlier copending application of common assignment entitled BIS-TRIAMINOGUANIDINE DECAHYDRODECABORATE AND A PROCESS FOR ITS PREPARATION, filed January 24, 1977, Ser. No. 762,229, and now U.S. Pat. No. 4,130,585.

BACKGROUND AND BRIEF DESCRIPTION OF THE INVENTION

The present invention describes a family of new and unique pyrotechnic compositions, propellants based on them, and a method of preparing same. The basic compositions consist of mixtures or coprecipitates of bis-triaminoguanidinium decahydrodecaborate and triaminoguanidine nitrate, in any proportions.

A particular objective in preparing compounds suitable for certain types of pyrotechnic usage is to achieve a high gas output and low molecular weight combustion products, when the compound is burned. Combustion products such as hydrogen ($H_2$) and nitrogen ($N_2$) gas fulfill this requirement. In preparing salts useful as pyrotechnic monopropellants and oxidizers from an anion such as decahydrodecaborate (−2) ($B_{10}H_{10}^{-2}$) or nitrate ($NO_3^-$), it has been found advantageous to use a cation containing a high weight fraction of atomic nitrogen and hydrogen. The triaminoguanidinium ion, chemical formula $C(NHNH_2)_3^{+1}$, has been found to be such a cation. In addition, the corresponding Brønsted base of the ion, free triaminoguanidine, is a strong base, which imparts to the cation, and thus the salt, a high degree of chemical stability.

Triaminoguanidine nitrate, $(NHNH_2)_3CNO_3$, also known to those practiced in the art as TAGN, has been found to have particular usefulness as an oxidizer in certain classes of propellants. It is by itself a slow, cool burning monopropellant with high gas output. One of the most serious drawbacks with the use of TAGN is the control of burning rate of the neat material, as well as propellants containing it.

This invention describes compositions employing TAGN as a starting material that have pyrotechnic performance superior to pure TAGN, in terms of energy and gas output and burning rate control. In particular, very fast burning, high energy propellants can be manufactured from them. The subject compositions consist of very intimate blends or coprecipitates of an ultrafast deflagrating monopropellant, namely the triaminoguanidinium salt of decahydrodecaboric acid, with TAGN. The resulting compositions, which can be prepared over a wide range of the constituent anion content, have pyrotechnic properties wholly unlike the starting salts.

Historically, boron hydride salts, in particular the nonmetal salts of decahydrodecaboric acid, has been discovered to have particular utility in the field of high energy fuels. They may be used as constituents of pyrotechnic compositions and in propellants. For example, non-metallic salts of the decahydrodecaborate ion, and exemplary uses, are disclosed in the copending application of common assignment entitled IGNITION AND PYROTECHNIC COMPOSITIONS, Ser. No. 694,625, filed June 10, 1976, now abandoned. For these compositions, in general, the ratio of decahydrodecaborate fuel to oxidizer was fixed within certain defined limits in order to achieve acceptable pyrotechnic performance.

The particular decahydrodecaborate salt used in this invention is the fully amino-substituted compound, which is disclosed in my copending patent application of common assignment entitled BIS-TRIAMINOGUANIDINIUM DECAHYDRODECABORATE AND A PROCESS FOR ITS PREPARATION, U.S. Pat. No. 4,130,585, incorporated herein by reference. In contrast to other simple decahydrodecaborate salts, the triaminoguanidine salt is a powerful monopropellant; i.e., combusts by itself releasing internal energy, without need of additional oxidizer materials. The compound is very unusual in that it contains only boron, nitrogen, carbon and hydrogen, but no oxygen.

The advantage of the chemical system formed by combining the two monopropellants is that they can be mixed in any proportion and, as well, both possess the triaminoguanidine ion as a common cation.

The preferred method of preparing a compound with a given stoichiometry consists of dissolving the two starting salts in water and rapidly precipitating the constituent ions simultaneously with a nonsolvent such as isopropanol. The detailed methodology for this process, known as "coprecipitation", has been disclosed in my copending application entitled COPRECIPITATED PYROTECHNIC COMPOSITION PROCESSES AND RESULTANT PRODUCTS, Ser. No. 694,626, filed June 10, 1976 now U.S. Pat. No. 4,135,956. This process for preparing the subject compositions makes use of the triaminoquanidinium cation which is common to both starting salts, and coprecipitates of the two salts result in very intimate mixing of the $B_{10}H_{10}^{-2}$ and $NO_3^-$ anions which helps impart to the resulting compositions very reproducible pyrotechnic performance.

Figure 1:
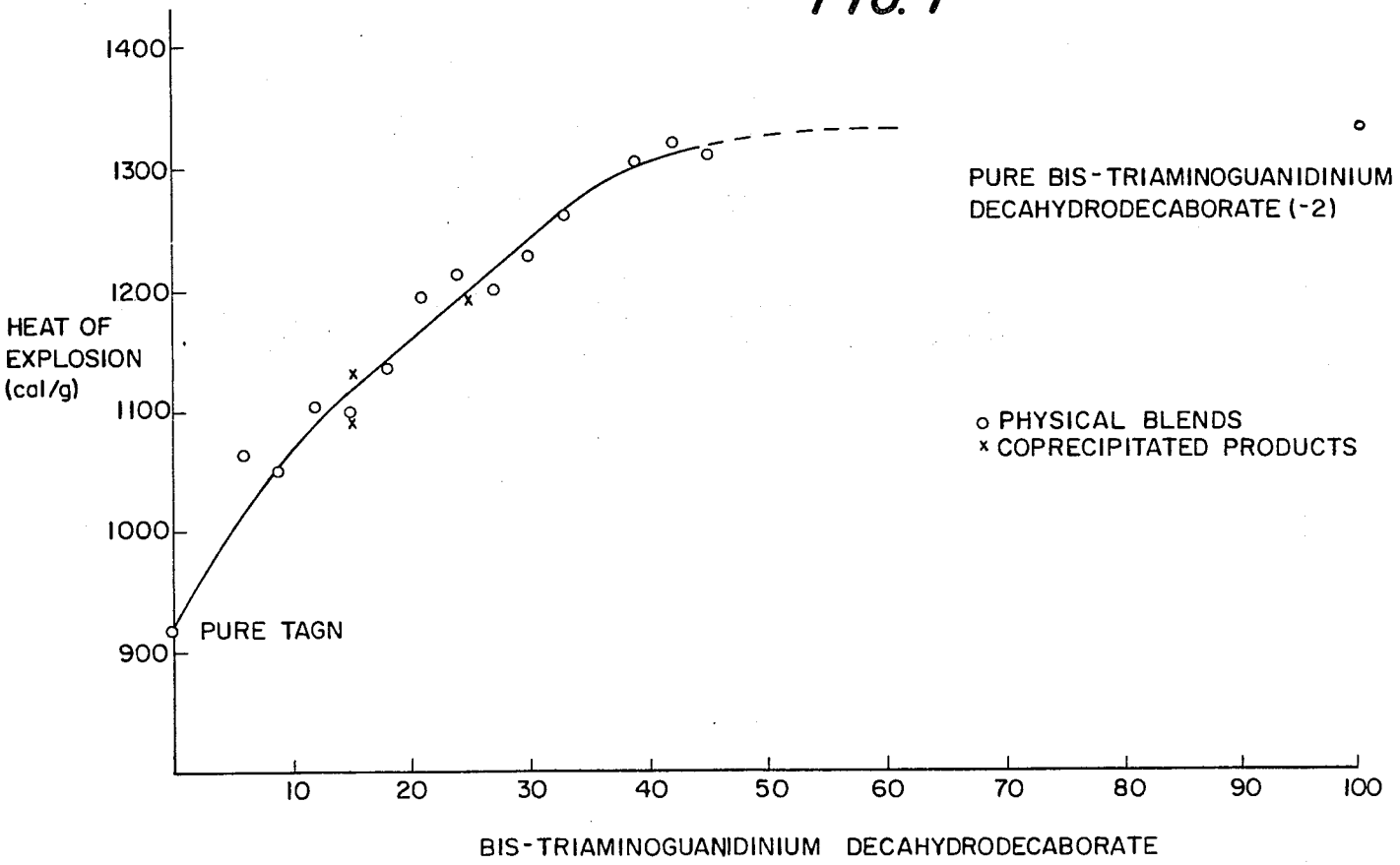
FIG. 1 is a graph showing the heat of explosion of the subject composition as a function of the decahydrodecaborate salt content.

DETAILED DESCRIPTION OF THE INVENTION:

General Information

The compositions of this invention are described by the general chemical formula $$x[(NHNH_2)_3CNO_3]\cdot(1-x)\,[(NHNH_2)_3C)_2B_{10}H_{10}]$$

where x can vary between 0.01 and 0.99. Preferred compositions have $0.5 < X < 0.99$.

The subject compositions are prepared by blending or combining the starting salts:

(a) bis-triaminoguanidinium decahydrodecaborate (−2), $[(NHNH_2)_3C]_2B_{10}H_{10}$, and (b) triaminoguanidine nitrate (TAGN), $(NHNH_2)_3CNO_3$ in such a manner as to achieve very intimate mixing. A coprecipitation process, as will be described below, is a preferred method of preparing the compositions.

TAGN

The triaminoguanidine nitrate, which is classified for shipping purposes as "Explosive, Class A", can be obtained from several commercial sources, but may be conveniently prepared in the laboratory according to the reaction:

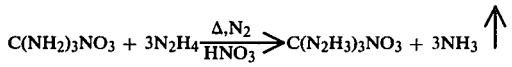

$$C(NH_2)_3NO_3 + 3N_2H_4 \xrightarrow[HNO_3]{\Delta, N_2} C(N_2H_3)_3NO_3 + 3NH_3 \uparrow$$

In this method, 1 part-by-weight guanidine nitrate $[(NH_2)_3CNO_3]$, 2.3 parts-by-weight hydrazine hydrate $(N_2H_4 \cdot H_2O)$, 2.4 parts-by-weight water, and 0.5 parts-by-weight nitric acid ($HNO_3$, 90%) are combined in a suitable vessel and heated to 80°–85° C. Heating is maintained for two hours, with dry nitrogen ($N_2$) bubbled through the mixture. The solution is cooled and allowed to stand for 8 hours, after which period the triaminoguanidine nitrate is recovered as a white precipitate. The product may be purified by recrystallization.

Bis-triaminoguanidinium Decahydrodecaborate

The bis-triaminoguanidine decahydrodecaborate salt may be prepared by neutralizing one mole of aqueous decahydrodecaboric acid, $H_2B_{10}H_{10}$, (or as the hydronium form, $(H_3O^+)_2B_{10}H_{10}^{-2}$), with two moles of the aqueous free base $[C(NHNH)_2]_2(NNH_2)$.

The aqueous decahydrodecaboric acid used as a starting material for the process of this invention is conveniently prepared by passing an amine or metal salt of the decahydrodecaborate (−2) ion through a column containing a strongly acidic ion exchange resin of the sulfonic acid type, such as a DUOLITE type C-20, manufactured by the Diamond Shamrock Corporation. Preferred starting salts are bis (triethylammonium) decahydrodecaborate (−2) and disodium decahydrodecaborate (−2). The preparation and properties of the aqueous acid itself are knowm, and reference may be made to KNOTH, U.S. Pat. No. 3,148,939, for further detail.

The free base of triaminoguanidine may be prepared by passing a chloride, nitrate, or other water soluble salt of triaminoguanidine through a column containing a strongly basic ion exchange resin of the polystyrene type, such as DOWEX$^R$2−X8, manufactured by the Dow Chemical Company of Midland, Michigan.

The neutralization preparation where the concentrations of the reacting aqueous solutions are approximately 0.3 molar, results in an immediate precipitation of the desired product. Upon filtering, washing with cold water, purification by recrystallization or reprecipitation in isopropanol, and washing with butyl acetate (to aid in drying) a brilliant white powder with a prilled appearance is recovered, which can be demonstrated to be the subject compound of a purity exceeding 97%.

Other preparative methods employing simple metathesis are obvious. For example, the product could be recovered by mixing aqueous solutions of salts containing the substituent ions, such as aqueous triethylammonium decahydrodecaborate and aqueous triaminoguanidine hydrochloride, such that the desired product precipitates and the undesired ions remain in solution.

The detailed preparation and properties of the bis triaminoguanidine decahydrodecaborate salt, which is by itself useful as a pyrotechnic monopropellant, are given in my copending patent application, U.S. Pat. No. 4,130,585, as referenced above.

Preparation of Subject Compositions via Physical Blending

The compositions of this invention may be prepared by intimately mixing the finely divided constituents by hand or in conventional mixing equipment. A liquid carrier such as butyl acetate or trichloroethylene may be employed to facilitate mixing or addition of binder; the liquid is subsequently evaporated to yield the dry composition. The physical blending process, in general, and as applicable to other decahydrodecaborate salts and oxidizers, is described further in the copending application of common assignment, Ser. No. 694,625, as referenced above.

General Description of the Coprecipitation Process

In general, the physical blends of oxidizer with the decahydrodecaboric acid salts, as described in the copending application, Ser. No. 694,625, noted above, suffer from several deficiencies inherent in the physical blend properties and processing technique. When used as a confined column delay, in a lead sheath, for example, the burn rates may be unreproducible, and the column fails to propagate below a certain critical distribution of the mixture in the tube. The stoichiometry of a physical blend is always subject to point-to-point variations due to blending techniques, settling and separation of the separate ingredients, and particle size distributions of the constituent materials.

A method is thereby needed to produce a composition with very uniform composition, in which the fuel anion and oxidizer are in very intimate contact, and which is very reproducible in manufacturing techniques from lot to lot. It has been discovered that such an intimate mixture can be obtained if the decahydrodecaborate (−2) anion is mixed in the crystal lattice with the oxidizing agent, in this case a nitrate ion, and if crystals containing the respective ions and oxidizing agents are intimately intertwined.

The process by which the compositions of the referenced invention are prepared produces a very intimate blend of decahydrodecaborate (−2) ion with the oxidizer, and makes the compositions so prepared chemically and physically unique from physical blends of decahydrodecaborate (−2) salts with oxidizer or pyrotechnic compositions incorporating decahydrodecaborate (−2) salts produced by other means. In general, the process consists of dissolving, in a suitable solvent, a decahydrodecaborate (−2) salt, and also dissolving, in the same solution, the oxidizing agent. The subject composition is recovered by precipitating the composite ingredients of the solution with a suitable nonsolvent. The resulting solid, after filtration and drying, comprises an intimate mixture of the decahydrodecaborate (−2) anion with the oxidizing cation or substance, in a form that is chemically and physically different than the starting materials.

The process may be properly called a "cocrystallization" or "coprecipitation" and the resulting product a "cocrystallate" or "coprecipitate". The detailed requirements and description of the process is given in the TABLE I-continued

| PARAMETER | EX. I | EX. II | EX. III |
|---|---|---|---|
| impact sensitivity, cm[2] | 8 | 6 | — |
| electrostatic sensitivity, millijoules[3] | — | >225 | — |
| autoignition temperature, °C.[4] | 250 | 240 | 247 |
| true density (g/cc) | 1.46 | 1.38 | 1.60 |

[1]Parr Bomb under argon.
[2]Enclosed Bureau of Mines tool, ½ kg drop, no grit.
[3]2 electrode, 0.020 inch gap, open cup, 500 pF capacitor, no resistor.
[4]5 sec Woods metal bath.

EXAMPLE II 22.5 grams bis-triaminoguanidine decahydrodecaborate and 126.4 grams triaminoguanidine nitrate are dissolved in 250 ml deionized water at 50° C. The hot solution was charged into a laboratory model coprecipitator, as described in application Ser. No. 694,626. The product is obtained by precipitation with 5 times the solution volume of anhydrous isopropanol; flow rates of 200 cc/min of the solution and 1000 cc/min isopropanol, with a mixing head gap of 0.030 inches are used. The resulting product is recovered in a filter, washed with butyl acetate, dried at 60° C., and spatulated.

Pyrotechnic characteristics of the resulting composition are also given in Table I, above.

EXAMPLE III 28.3 grams bis-triaminoguanidinium decahydrodecaborate and 85 grams triaminoguanidine nitrate are dissolved in 1000 ml deionized water at 60° C. The hot solution is poured slowly into a stainless pot containing 5000 ml anhydrous isopropanol agitated with a high speed stirring apparatus. The resulting precipitate is filtered, washed with butyl acetate in the filter, dried 24 hours at 125° F., and spatulated.

Pyrotechnic characteristics of the resulting compositions are also given in Table I, above.

EXAMPLE IV

A free energy minimization thermochemical analysis, as commonly performed by those practiced in the art, is run on a hypothetical composition comprising 15%-by-weight bis-triaminoguanidinium decahydrodecaborate and 85%-by-weight triaminoguanidine nitrate, representative of the compositions produced as Examples I and II. Representative combustion parameters of the composition burning in a chamber at 1000 psi and exhausted through a nozzle are given in Table II. The propellant has low flame temperature and very high gas output.

TABLE II

COMBUSTION PARAMETERS OF 15%-BY-WEIGHT BIS-TRIAMINOGUANIDINUM DECAHYDRODECABORATE AND 85%-BY-WEIGHT TAGN

| PARAMETER | 1000 psi | EXPANDED |
|---|---|---|
| Specific impulse (ft-lb/lb) | 0 | 245 |
| Specific impulse (vacuum, ft-lb/lb) | 0 | 264 |
| Flame temperature (isobaric, °K.) | 2103 | 986 |
| Gamma | 1.26 | 1.28 |
| Flame temperature (isochoric, °K.) | 2650 | 1262 |
| Gas output (moles/100g) | 5.66 | 5.45 |
| Gas molecular weight | 15.9 | 15.5 |
| Product molecular weight | 17.7 | 18.4 |

Used as a gun propellant, the impetus of the system (without binder) is 416,000 (ft-lb/lb), which is substantially higher than either nitramine propellants currently known or, as well, nitrocellulose propellants. Primary combustion products after expansion are (in units of moles/100g):

$H_2$: 2.5
$N_2$: 2.1
CO: 0.5
$H_2O$: 0.23
$B_2O_3$: 0.22

EXAMPLE V

Figure 2:
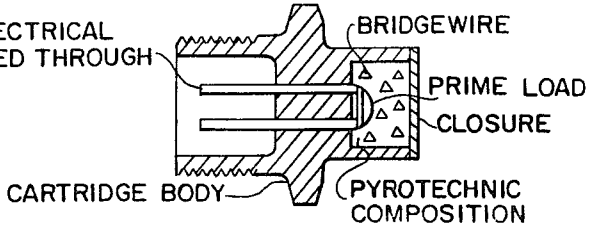
FIG. 2 illustrates a conventional pressure cartridge for testing the material, as according to Example V.

The utility of the subject compositions as very high pressure-producing compositions is illustrated by loading approximately 100 milligrams of the subject compositions into a closed pressure cartridge of a well-known type as shown in FIG. 2, and firing the pressure cartridge in a 10 cc closed bomb. The pressure in the bomb is measured by a fast response transducer and recorded as a function of time. The pressure cartridge consists of an exploding bridgewire mounted in a suitable cartridge case. The bridgewire is primed with a 53 mg of an initiating pyrotechnic powder. The subject composition is loaded into the cartridge over the priming load, and the cartridge closed with a crimped or welded cap. The function time of the compositions is taken as the time between the application of current to the bridgewire to the peak pressure.

When tested in this manner, 96 mg of the composition from Example II produces a peak pressure of 1600 psi in 4 milliseconds. By contrast, to produce a comparable pressure rise, 120 g of a commonly used high speed composition, [consisting of 22 parts-by-weight finely divided zirconium, 17.5 parts-by-weight potassium perchlorate, 1.7 parts-by-weight binder, and 58 parts-by-weight "Hi Temp" (Hercules Powder Co., an RDX/wax composition)] is required.

EXAMPLE VI

The utility of the subject compositions when used in a propellant described in the copending application of common assignment entitled HIGH BURNING RATE PROPELLANTS WITH COPRECIPITATED SALTS OF DECAHYDRODECABORIC ACID, filed July 22, 1976 and assigned Ser. No. 707,810, is illustrated by preparing a propellant with the following formulation:

| | |
|---|---|
| Composition from Example II | : 70% |
| Nitrocellulose (12.6%N) | : 17% |
| Dinitrotoluene | : 7% |
| Acetyl Tributyl Citrate | : 6% |

The propellant ingredients are slurried in a 75%-by-volume ethanol/25%-by-volume butyl acetate solvent and charged into a one-pint Baker Perkins sigma blade dough mixer. The solvent is removed under vacuum at 120° F. and a thick dough obtained. The dough is extruded into ¼ inch diameter burning rate strands using a 6-inch air operated press and 1-inch barrel extruder. Further drying at 120° F. for several weeks follows.

The strands are fired in a closed bomb strand burner, as commonly used by those practiced in the art. A burning rate of 475 inches per second is measured with the bomb pressurized to 2000 psi, which represent burning rates wholly unachievable with state-of-theart propellants.

copending application of common assignment, entitled COPRECIPITATED PYROTECHNIC COMPOSITION PROCESSES AND RESULTANT PRODUCTS, filed June 10, 1976 and now U.S. Pat. No. 4,135,956, and is incorporated herein by reference.

Preparation of Subject Compositions via Coprecipitation

The coprecipitation process is a preferred method of preparing compounds of this invention. In the general method, the requisite quantities of the salts (a) bis-triaminoguanidinium decahydrodecaborate (−2), and (b) TAGN, are dissolved in hot water at approximately 70° C. A preferred solution concentration is approximately 0.3–0.1 molar in $B_{10}H_{10}^{-2}$, due to the relatively low solubility of the salt (a). The ions in the hot solution are precipitated by rapidly mixing one part-by-volume of the hot solution with five parts-by-volume isopropanol (anhydrous), in an apparatus and via the method described in the above-noted U.S. Pat. No. 4,135,956. The resulting precipitate is filtered, washed in butyl acetate, and dried, to yield a white, fluffy powder. Where small quantities of the subject compositions are desired, for example 150 grams or less, satisfactory results can be obtained by effecting the rapid precipitation by hand, i.e., slowly pouring the hot solution into a pot containing rapidly stirred isopropanol.

The resulting product contains stoichiometrically the substituent ions from starting salts (a) and (b), but in different chemical environments than in the starting salts. Specifically, there is interlattice and intercrystalline mixing of the substituents, notably the $B_{10}H_{10}^{-2}$ and $NO_3^-$ ions, a chemical state not obtainable by physical blending. This state mixing results in compositions with more uniform and predictable burning than compositions obtained by other methods of combining the ingredients.

The choice of the ratio of starting salt (a) to starting salt (b) depends on the application requirements. A unique and exceptionally useful feature of the subject compositions is that salts (a) and (b) may be combined in virtually any proportions, although compositions containing 50% or more by weight triaminoguanidine nitrate are preferred for economic reasons. The pyrotechnic performance and utility of the composition system is illustrated by FIG. 1, which shows the heat of explosion of the subject compositions as a function of the decahydrodecaborate salt (a) content. This curve (FIG. 1) was generated by preparing physical blends of salts (a) and (b) in the proportions indicated, and igniting a sample of the composition in a closed Parr bomb in an argon atmosphere. The heat of reaction, or more commonly termed by those practiced in the art "heat of explosion", is derived by measuring the temperature rise in a water bath surrounding the reaction vessel. This heat of explosion as a function of decahydrodecaborate salt (a) content is a smooth, monotonically increasing function to at least 50% byweight salt (a), starting at 940 cal/g (pure TAGN) and approaching 1325 cal/gram (pure bis-triaminoguanidinium decahydrodecaborate). Coprecipitates of salts (a) and (b), as indicated on FIG. 1, have heats of explosion very near that derived for physical blends, indicating that no significant change in burning mechanism accompanies the coprecipitation process.

Application of The Subject Compositions

The subject compositions can be used per se as ignition compounds mixed with other ingredients, or manufactured into propellants. Other additives may be employed to alter the processing, handling, or other properties of the mix. These are known, per se, and may include binders such as casein, gum arabic, dextrins, waxes, polymeric materials such as polyurethanes, epoxies, natural or synthetic rubbers, copolymers or a rubber and plastic such as styrenebutadiene, methyl cellulose, and nitrocellulose. Polyethylene glycol of average molecular weight 4000 is a preferred known additive. These ingredients are commonly used in concentrations up to 8% by weight.

A major usage of the subject compositions in in ultra high burn rate propellants, where the coprecipitated composition is used as a major fraction of the solids content of the propellant. These propellants and methods for their preparation are further described in the copending application of common assignment entitled HIGH BURNING RATE PROPELLANTS WITH COPRECIPITATED SALTS OF DECAHYDRODECABORIC ACID, Ser. No. 707,810, now U.S. Pat. No. 4,138,282. When used in accordance with the formulations taught in the aforementioned disclosure, the subject propellants would have the general formula:

| | | Probable Range, % by Wt. |
|---|---|---|
| 1. | Polymeric binder system | 8–35 |
| 2. | Curing, polymerizing, or cross-linking agents | 0–10 |
| 3. | Plasticizing agents | 0–25 |
| 4. | Pure decahydrodecaborate salts | 0–25 |
| 5. | Coprecipitated triaminoguanidine nitrate/bis triaminoguanidinium decahydrodecaborate | 35–90 |
| 6. | Energetic fuels, such as, but not limited to, finely divided aluminum | 0–10 |
| 7. | Oxidizer or mixture of oxidizers to supplement (5) | 0–15 |
| 8. | Other inert ingredients, such as colorants, stabilizers. | 0–10 |

The unique products of this invention, and representative usages are further illustrated by the following Examples.

EXAMPLE I 1.5 grams bis-triaminoguanidinium decahydrodecaborate and 8.5 grams triaminoguanidine nitrate are dissolved in 100 milliliters deionized water at 50° C. The ingredients are rapidly precipitated by pouring into 500 ml stirred anhydrous isopropanol. A white powder precipitates immediately, and is recovered by filtration, washed in the filter with n-butyl acetate, and dried in an oven at 60° C.

A series of standard pyrotechnic characterization tests are run on the dried powder; results are summarized in Table I.

TABLE I

| PARAMETER | EX. I | EX. II | EX. III |
|---|---|---|---|
| method of manufacture | hand | lab coprecipitator | hand |
| % bis-triaminoguanidinium decahydrodecaborate | 15 | 15 | 25 |
| heat of explosion, cal/gram[1] | 1129 | 1089 | 1159 |

A free energy minimization program is run on this propellant to assess its utility as a gun or rocket propellant; parameters are summarized in Table III. The derived impulse of 360,000 ft-lb/lb is typical of that achievable with single base propellants. This value can be raised substantially by reducing the plasticizer content of the propellant, or, for rocket propellants, adding aluminum.

TABLE III

COMBUSTION PARAMETERS OF PROPELLANT CONTAINING COPRECIPITATED PRODUCT

| PARAMETER | 1000 psi | EXPANDED |
|---|---|---|
| Specific Impulse (lb-sec/lb) | — | 226 |
| Specific Impulse (vacuum, lb-sec/lb) | — | 246 |
| Flame Temperature (isobaric, °K.) | 1815 | 967 |
| Gamma | 1.27 | 1.27 |
| Flame Temperature (isochoric, °K.) | 2305 | 1228 |
| Gas Output (moles/100g) | 5.63 | 5.14 |
| Gas Molecular Weight | 15.9 | 16.8 |
| Product Molecular Weight | 17.8 | 19.45 |
| Impulse (ft-lb/lb) | 360,000 | |

While various examples of the subject compositions have been given, and preparatory methods taught, it is to be understood that the invention is to be defined by the scope of the appended claims.

I claim:

1. The composition having the general formula $$x[(NHNH_2)_3CNO_3]\cdot(1-x)\,[(NHNH_2)_3C)_2B_{10}H_{10}]$$

wherein the value of x is between 0.01 and 0.99.

2. The composition of claim 1 wherein the value of x is between 0.5 and 0.99.

3. A mixture comprising an intimate physical blend of the triaminoguanidinium salt of decahydrodecaborate acid, $(C(NHNH_2)_3)_2B_{10}H_{10}$ and triaminoguanidine nitrate, $(NHNH_2)_3CNO_3$, wherein said nitrate comprises from between approximately 1% and 99%, by weight, of said mixture.

4. A product having the formula:

$$x[(NHNH_2)_3CNO_3]\cdot(1-x)[((NHNH_2)_3C)_2B_{10}H_{10}]$$

wherein the value of x varies between 0.01 and 0.99 said product being formed by a coprecipitation process between the triaminoguanidinium salt of decahydrodecaboric acid and triaminoguanidinium nitrate by the steps of:

(A) dissolving both said decahydrodecaborate salt and said nitrate in a mutually soluble solvent, at a temperature sufficiently high to maintain said salt and said nitrate in solution;

(B) forming a pressurized stream of said solution and bringing said solution stream together with a pressurized stream of a miscible nonsolvent, under conditions of extreme turbulence within a mixing chamber, to effect a substantially complete coprecipitation;

(C) recoverning the coprecipitated product by filtering the effluent from said mixing chamber, and washing said product with an inert and nonsolvent fluid;

(D) drying the product to remove all remaining liquid.

5. The product of claim 4 wherein said mutually soluble solvent is water and said solution concentration is approximately 0.3 to 0.1 molar in $B_{10}H_{10}^{-2}$, wherein said coprecipitation step further comprises rapidly mixing approximately one part-by-volume of said solution with five parts-by-volume of said miscible nonsolvent.

6. The composition of claim 1 wherein further the composition is a coprecipitate and the substituent ions $B_{10}H_{10}^{-2}$ and $NO_3^-$ are intimately intertwined through interlattice and intercrystalline mixing.

7. The coprecipitate of claim 6 wherein the value of x is between 0.5 and 0.99, and said coprecipitate is the product of a process comprising the steps of dissolving the triaminoguanidinium salt of decahydrodecaboric acid and triaminoguanidinium nitrate in water to form a solution and simultaneously precipitating the constituent ions by adding said solution to a miscible nonsolvent.

8. A compositions according to claim 1 wherein x is approximately 0.85 and 0.75.

* * * * *